US006851335B2

(12) United States Patent
Johnson

(10) Patent No.: US 6,851,335 B2
(45) Date of Patent: Feb. 8, 2005

(54) TONG WITH COMPOSITE BELT AND METHODS FOR MAKING AND USING SAME

(75) Inventor: Patrick Johnson, Clifton, TX (US)

(73) Assignee: Orbix Corporation, Clifton, TX (US)

( * ) Notice: Subject to any disclaimer, the term of this patent is extended or adjusted under 35 U.S.C. 154(b) by 0 days.

(21) Appl. No.: 10/366,586

(22) Filed: Feb. 13, 2003

(65) Prior Publication Data

US 2003/0177873 A1 Sep. 25, 2003

Related U.S. Application Data

(60) Provisional application No. 60/358,043, filed on Feb. 19, 2002.

(51) Int. Cl.[7] ..... B25B 13/52

(52) U.S. Cl. ..... 81/64; 81/57.14; 81/57.17; 81/57.16; 81/57.2; 81/57.39

(58) Field of Search ..... 81/64, 57.14, 57.17, 81/57.16, 57.2, 57.39

(56) References Cited

U.S. PATENT DOCUMENTS

| | | | | |
|---|---|---|---|---|
| 1,925,970 A | | 9/1933 | Pennington | 81/57 |
| 2,523,159 A | | 9/1950 | Spinner | 255/35 |
| 3,859,694 A | * | 1/1975 | Lafond et al. | 24/271 |
| 3,892,140 A | | 7/1975 | Fox et al. | 74/224 |
| 4,079,640 A | * | 3/1978 | Golden | 81/57.17 |
| 4,099,429 A | | 7/1978 | Hauk | 81/57.17 |
| 4,200,010 A | | 4/1980 | Hewitt | 81/57.16 |
| 4,212,212 A | | 7/1980 | Chandler et al. | 81/57.17 |
| 4,212,577 A | | 7/1980 | Swanson | 414/23 |
| 4,471,674 A | * | 9/1984 | Doss | 81/57.17 |
| 4,512,216 A | | 4/1985 | Callegari, Sr. et al. | 81/57.17 |
| 4,604,922 A | | 8/1986 | Soutsos | 81/57.17 |
| 4,683,962 A | | 8/1987 | True | 173/163 |
| 4,694,712 A | | 9/1987 | Doss | 81/57.17 |
| 4,718,314 A | | 1/1988 | Coyle, Sr. et al. | 81/57.33 |
| 4,774,860 A | | 10/1988 | Hawke | 81/57.17 |
| 4,895,056 A | | 1/1990 | Schulze-Beckinghausen | 81/57.17 |
| 5,150,638 A | | 9/1992 | Penisson | 81/57.17 |
| 5,598,732 A | * | 2/1997 | Dischler | 72/292 |
| 5,619,883 A | * | 4/1997 | Dischler | 72/400 |

* cited by examiner

*Primary Examiner*—Joseph J. Hail, III
*Assistant Examiner*—Alvin J Grant
(74) *Attorney, Agent, or Firm*—Robert W. Strozier

(57) ABSTRACT

A manual tong is disclosed which includes a composite belt, a handle assembly, and a jaw assembly, where the composite belt is designed to take the place of the conventional linked chains used currently in manual tongs. The composite belt is held in place by a set of pins associated with the handle and jaw assemblies. Replacement of the linked chains with the composite belts improve tong safety, improve ease of use, lower cost, make adjustment easier and make belt replacement easier reducing down time and increasing tong utility so that one tong can be used for different pipe diameters by simply adjusting a length of the belt or a simple replacement of the belt with a different size belt.

19 Claims, 8 Drawing Sheets

TONG WITH COMPOSITE BELT AND METHODS FOR MAKING AND USING SAME

RELATED APPLICATION

This application claims provisional priority of U.S. Provisional Patent Application Ser. No. 60/358,043, filed 19 Feb. 2002.

BACKGROUND OF THE INVENTION

1. Field of the Invention

The present invention relates to a tong including a composite belt and methods for making and using same.

More particularly, the present invention relates to a tong including a handle assembly, a jaw assembly and a composite belt, where the belt is secured to the handle and jaw assemblies and the tong allows a pipe to be rotated or turned by detachably mounting the tong on a portion of the pipe, looping the belt over the outside of the pipe and tightening the belt to bring it into contact with the pipe surface and method for using the tong to rotate a pipe.

2. Description of the Related Art

Current tongs for use in the oil industry and other related industries use linked chains to wrap around piping (pipe strings) so that the pipe string can be broken-down or made up. Although these linked chains are manufactured to high precision and to withstand pressure well in excess of their operating limits, the chains can still fail, especially after long years of use. When such a linked chain fails, the chains can cause metal pieces to be ejected from the chain at relatively high velocity, which can and has resulted in injuries.

Thus, there is a need in the art for a tong apparatus that replaces the linked chain with a pipe engaging member that reduces down time in the event of failure and reduces the risk of harm to personnel and other equipment in the event of failure.

SUMMARY OF THE INVENTION

The present invention provides a tong apparatus including a composite belt.

The present invention provides a tong apparatus including a handle structure, a jaw structure, a composite belt and a belt holding and locking structure.

The present invention provides a tong apparatus including a handle assembly, a jaw assembly, a composite belt and a belt holding and locking assembly.

The present invention provides a tong apparatus including a handle structure, a jaw structure, a composite belt and a belt holding and locking structure.

The present invention provides a tong apparatus including a handle assembly, a jaw assembly, a composite belt and a belt holding and locking assembly.

The present invention provides a tong apparatus including a handle, a jaw, a jaw-handle pin, a master pin, an idler sprocket, a lock pin, a release arm, a spring, a composite belt, a hook, hook pins, a clamping pin, a guide pin, a belt handle grip, a hanger, and optionally an insert, where one end of the belt is attached to the handle, while the other end is attached to the jaw.

The present invention provides a tong apparatus including a handle, a jaw, a jaw-handle pin, a master pin, an idler sprocket, a lock pin, a release arm, a spring, a composite belt, a hook, hook pins, an anchor pin, a guide pin, a belt handle grip, a hanger, and optionally an insert, where one end of the belt is attached to the handle, while the other end is attached to the jaw.

The present invention provides method for turning a pipe including positioning a tong apparatus of this invention at a desired position on the pipe, wrapping the belt around the pipe, threading the belt through the locking structure, and tightening the belt against the pipe at the desired position. The method can also include turning the pipe using the tong handle.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
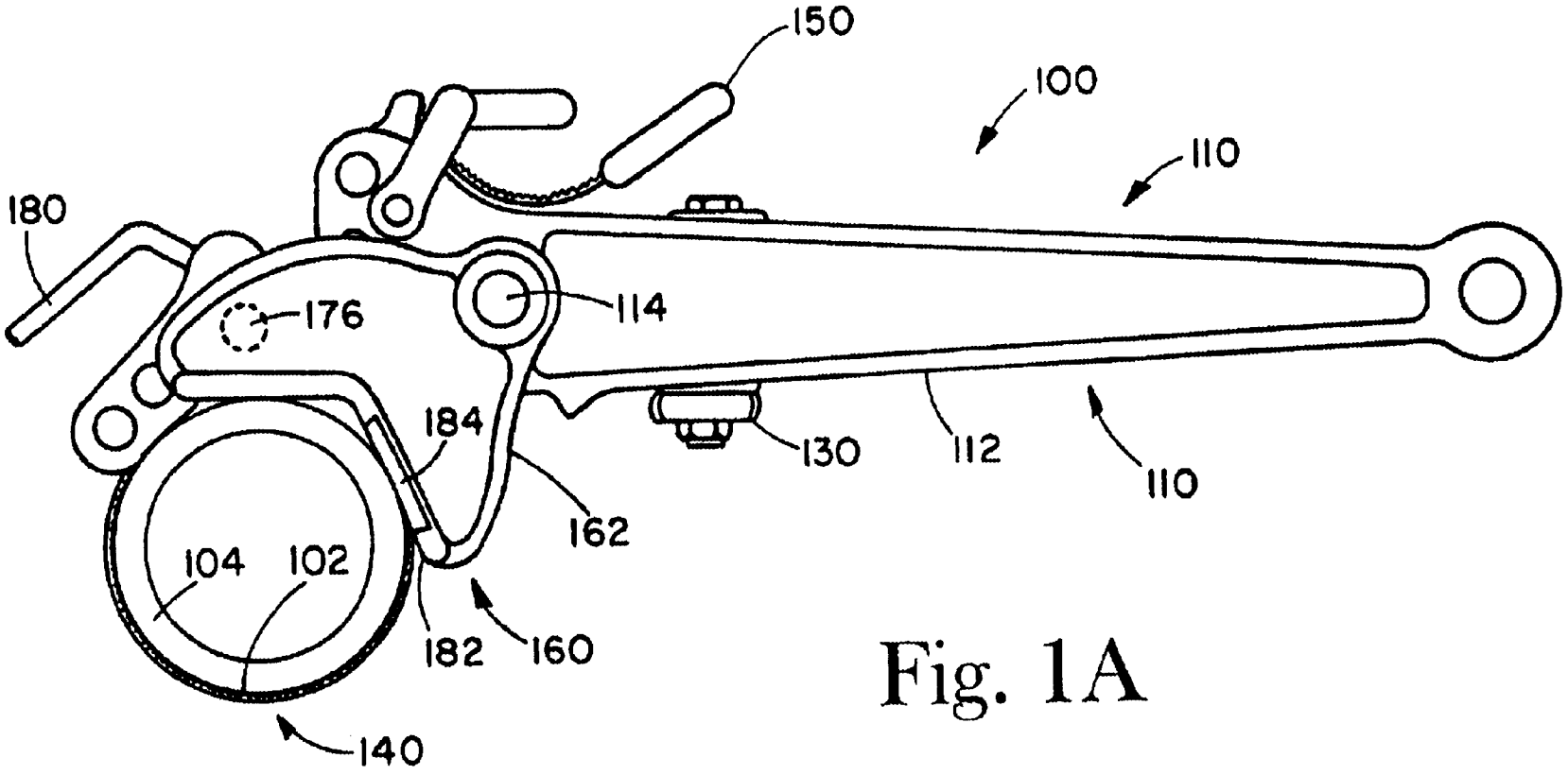
FIG. 1A depict a top plan view of one preferred embodiment of the tong apparatus of this invention.

The inventor has found that a pipe tong can be constructed using a non-continuous composite belt instead of a linked chain to engage a pipe and allow the tong to turn the pipe. The inventor has found that the composite belt yields a lighter weight tong with improved safety because failure of the composite belt reduces the risk of catastrophic failure of a linked-chain and reduces the risk of injury to workers from flying metal fragments. Moreover, the inventor has found that tongs including composites belts are easier to attach, maintain, and adjust than tongs with traditional linked chain engaging members. Furthermore, the inventor has found that tongs including composite belts allow for easier belt replacement in the event of belt failure, than is true for replacing a failed chain in conventional linked-chain tongs.

The tongs of this invention share some structural elements of traditional linked chain tongs. The tongs include a jaw assembly pivotally mounted on, connected to or attached to a handle assembly. The jaw assembly and belt are adapted to engage a pipe allowing the pipe to be rotated or turned. The belt is adapted to extend around the pipe and is anchored at one end to the jaw assembly and at its other end to the handle assembly. The belt is then tightened about the pipe via a ratchet or sprocketed subassembly associated with the handle assembly. Once tightened about the pipe, the belt and optionally a pipe engaging insert associated with the jaw assembly permits force to be transferred from the handle assembly to the pipe imparting a rotational motion of the pipe. Thus, the belt and jaw assembly forms a loop around the pipe.

The composite belts to be used in the tongs of this invention include a polymeric matrix reinforced by longitudinally extending continuous fibers, yarn, woven strings, wires, fiber bundles, wire bundles, fabric, meshes or mixtures or combinations thereof. The continuous fibers or wires or bundles thereof generally run parallel down the length of the belt at a desired spacing along the width of the belt. Preferably, the spacing is sufficient to allow complete encapsulation of each fiber, wire or bundle in the polymeric matrix. Although continuous fibers are preferred, thin metal wires can also be used or a combination of fibers and metal wires or bundles comprising fibers and wires can be used.

Suitable polymeric matrices for use in the belts of this invention include, without limitation, any type of plastic, thermoplastic or thermosetting material such as elastomers, thermoplastic elastomers, epoxy resins, phenolic resins, urethanes, or mixtures or combinations thereof. Generally, the matrices are cured with the fibers or wires or bundles embedded in the matrix. The curing can be accomplished by any curing method known in the art depending on the nature of the polymers making up the matrix including, without limitation, radiation curing, heat curing, light curing, or mixtures or combinations thereof. The curing can also be enhanced or accelerated by chemical cure system as is well known in the art. The matrices can also include additives such as filler including carboneous fillers such as carbon black or the like, fiber fillers such as chopped fibers including the fibers set forth below for the continuous fibers, and inorganic fillers such as silica, clay, calcium carbonate, zeolites, mordenites, fugacites, or the like or mixtures or combinations thereof. For further details relating to polymeric matrices and/or their cure systems the readers is directed to the following U.S. Pat. Nos.: 3,257,346, 3,517,722, 3,738,948, 3,931,090, 3,933,732, 4,130,519, 4,605,696, 4,633,912, 4,684,421, 5,254,616, 5,091,449, incorporated herein by reference. The matrices can also include anti-degradants such as anti-oxidants, anti-ozonants, or the like, plasticizers, flow enhancers, or the like.

In a preferred embodiment, the load bearing cords are encased in a polymeric matrix such as an urethane sheath. Thus, if the cords are loaded to their break point, they break one at a time, and after they all are completely broken, they remain within the matrix or sheath, preventing the cords from flying apart or the belt from flying apart. Generally, the urethane sheath or polymeric matrix encasing the cords is formulated to stretch with a maximum elongation to break of about 700% of its original length, with the main objective being that the fiber, wire or bundle break prior to the matrix. The ability for the sheath or matrix material to elongate to several times its original length before break, allows the handle to fold over safely in a controlled manner, while the tong and belt assembly maintain their integrity. If a failure occurs, no shrapnel is generated and because the handle is designed to be much stronger than the belt, the entire assembly is designed for belt failure, a safe failure mode (cord breaking within the encasing or surrounding polymeric matrix or sheath), eliminating any danger to nearby personnel.

Suitable continuous fibers for use in this invention include, without limitation, carbon fibers, boron-nitride fibers, polyamide fibers, polyimide fibers, glass fibers, or mixtures or combinations thereof. Sometimes the fibers can be coated with or treated with a material that will increase adhesion between the matrix and the fiber. Such treatments can also include physical treatments such as ion bombardments or ion implantations. However, many of these treatments may increase adhesion and/or bonding interactions between the fiber and the matrix, these treatments tend to reduce the tensile strength of the fibers. Therefore, the treatments are used only when the treated fiber has adequate tensile strength for the intended application.

Suitable metal wires include, without limitation, iron alloy wires or other similar metal wires having high tensile strengths. Generally, iron allow wires are coated with a bonding layer including copper, zinc, cobalt, brass, bronze, nickel, or the like or mixtures or combinations thereof. These coating improve the adhesion and/or bonding between the metal surface and polymeric matrix.

Referring now to FIGS. 1A&B, a preferred embodiment of a tong apparatus of this invention, generally 100, is shown to include a handle assembly 110, a composite belt 140 and a jaw assembly 160, where the tong 100 is adapted to engage a surface 102 of a pipe 104 so that the pipe 104 can be rotated or turned.

The handle assembly 110 includes a handle 112, which is designed to transmit rotational force to the pipe 104, and a jaw-handle pin 114, which is designed to pivotally mount the jaw assembly 160 on the handle assembly 110 and to provide leverage to tighten the belt 140 adequately about the pipe 104 and to bring the belt 140 into contact with the surface 102 of the pipe 104 and to maintain contact between the jaw assembly 160, the belt 140 and the pipe surface 102 so that the pipe 104 can be rotated or turned. The handle assembly 110 also includes a belt adjusting-locking assembly 116 having a master pin 118, an idler sprocket 120, a lock pin 122 and a spring loaded release arm assembly 124 having a release arm 126 and a spring 128. While the release arm assembly 124 is shown with spring 128, the assembly 124 well work equally well with any other type of biasing means well known in the art. The adjusting-locking assembly 116 produces a locking force on the belt 140 when tension on the belt 140 causes the sprocket 120 to be pulled into the master and lock pins 118 and 122. The release arm 126 is adapted to swing the sprocket 120 away from the pins 118 and 122 to allow for belt clearance for subsequent belt length adjustment, while the spring 126 provides an self-energizing, initial clamping force on the belt 140. The handle assembly 110 also includes a hanger 130 adapted to suspend the tong 100 when working on a pipe that is oriented vertically.

The belt 140 comprises a high tensile strength fiber reinforced polymeric matrix, where the belt 140 is adapted to maintain intimate contact between the tong 100 and the pipe 104. The belt 140 is described in more detail in association with FIGS. 3A–D and FIGS. 4A–E. As seen here, the belt 140 includes teeth, ribs or ridges (see FIGS. 4A–E) on a pipe engaging surface 144, while a non-engaging surface 146 is smooth. Of course, both surfaces can include teeth, ribs or ridges. The teeth, ribs or ridges form valleys therebetween, where the teeth, ribs or ridges and the valleys are adapted to provide channels for liquid and/or semi-solid contaminants on the surface 102 of the pipe 104 to be squeezed away from the surface 102 of the pipe 104 as the belt 140 is tightened about the pipe 104. This squeezing action is designed to improve contact between the engaging surface 144 of the belt 140 and the surface 102 of the pipe 104. The belt 140 can also include a belt handle grip 150 adapted to provide a convenient method for pulling on an adjustable end 152 of the belt 140 for belt adjustment. The other end 154 of the belt 140 is fixed in place in the clamping assembly of the jaw assembly described below.

The belt 140 can provide some or all of the frictional interface between the tong 100 and the pipe 104 for transmitting torque from the handle 112 to the pipe 104.

The jaw assembly 160 is pivotally mounted on the jaw pin 114 and includes two jaw plates 162 and a hook assembly 164. The hook assembly 164 anchors the belt 140 to the jaw assembly 160. The hook assembly 164 includes a clamping pin 166 and a guide pin 168. The clamping pin 166 is adapted to clamp the free end 154 of the belt 140 against a portion 170 of the belt 140 that is under tension. The guide pin 168 re-routes the belt 140 (the belt 140 loops around the guide pin 168) to provide for clamping of the free end 154 underneath the belt portion 170 which is under tension. Such a pin arrangement provides for a clamping force on the free end 154 of the belt 140 that is proportional to the belt tension and as such will prevent slippage of the belt 140. The hook assembly 164 also includes a hook 172 having recessed hooking regions 174 adapted to receive a hook pin 176 extending from each jaw plate 162, where the hooks 172 are separated by a central tab 178. The hook assembly 160 also includes a hook handle 180 adapted to move the hook assembly 164 from an engaged state to an unengaged state.

The jaw plates 162 are designed to engage the pipe surface 102 at their exterior surface 182. The jaw assembly 160 can also include an insert 184 which is a toothed metallic part with high hardness to penetrate the surface 102 of the pipe 104 to provide additional tong engagement of the pipe surface 102, i.e., provide a high shear stress engagement between the tong and the pipe as a means of transmitting torque to the pipe. In some instances the insert 184 may be smooth or even absent when adequate frictional forces are provided by the belt and jaw assembly.

Figure 1B:
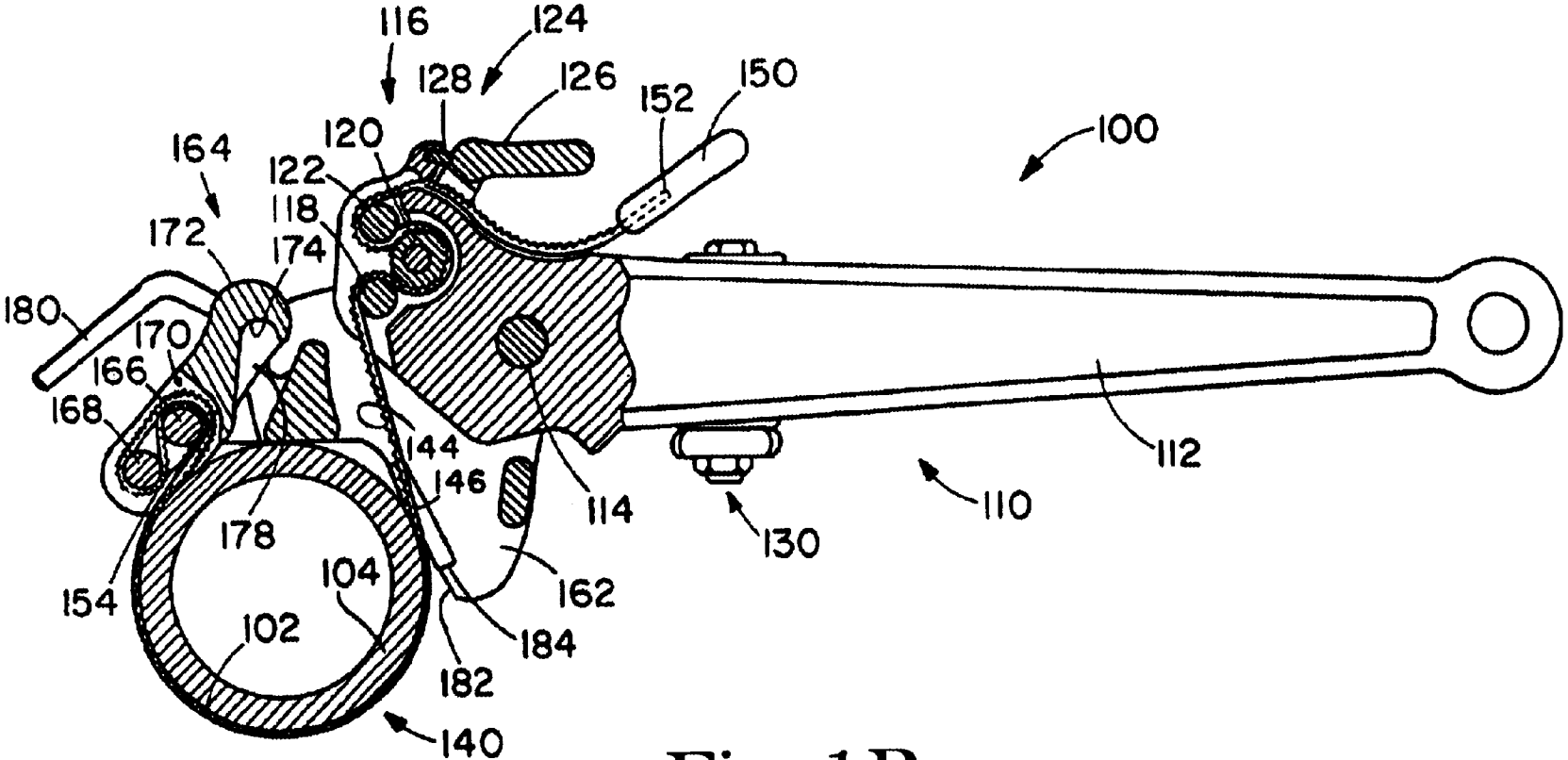
FIG. 1B depicts a top cut away view of the tong apparatus of FIG. 1.

The tong 100 is used by positioning the tong 100 on the pipe 104 so that the outer surface 182 of the jaw plates 162 engage the pipe surface 102. Next, the free belt end 154 is threaded through the belt adjusting-locking assembly 116 as shown in FIG. 1B and then around the pipe 104. Once the belt end 154 is extended around the pipe 104, the belt end 154 is threaded through the hook assembly 164 as shown again in FIG. 1B. The belt handle 150 is then pulled to adjust the belt 140 pulling the idle sprocket 120 into the pins 118 and 122 and applying tension to clamp the belt end 154 in the hook assembly 164. The handle 112 can then be used to rotate the pipe via the belt engaging surface 144 and the jaw surface 182.

Figure 2A:
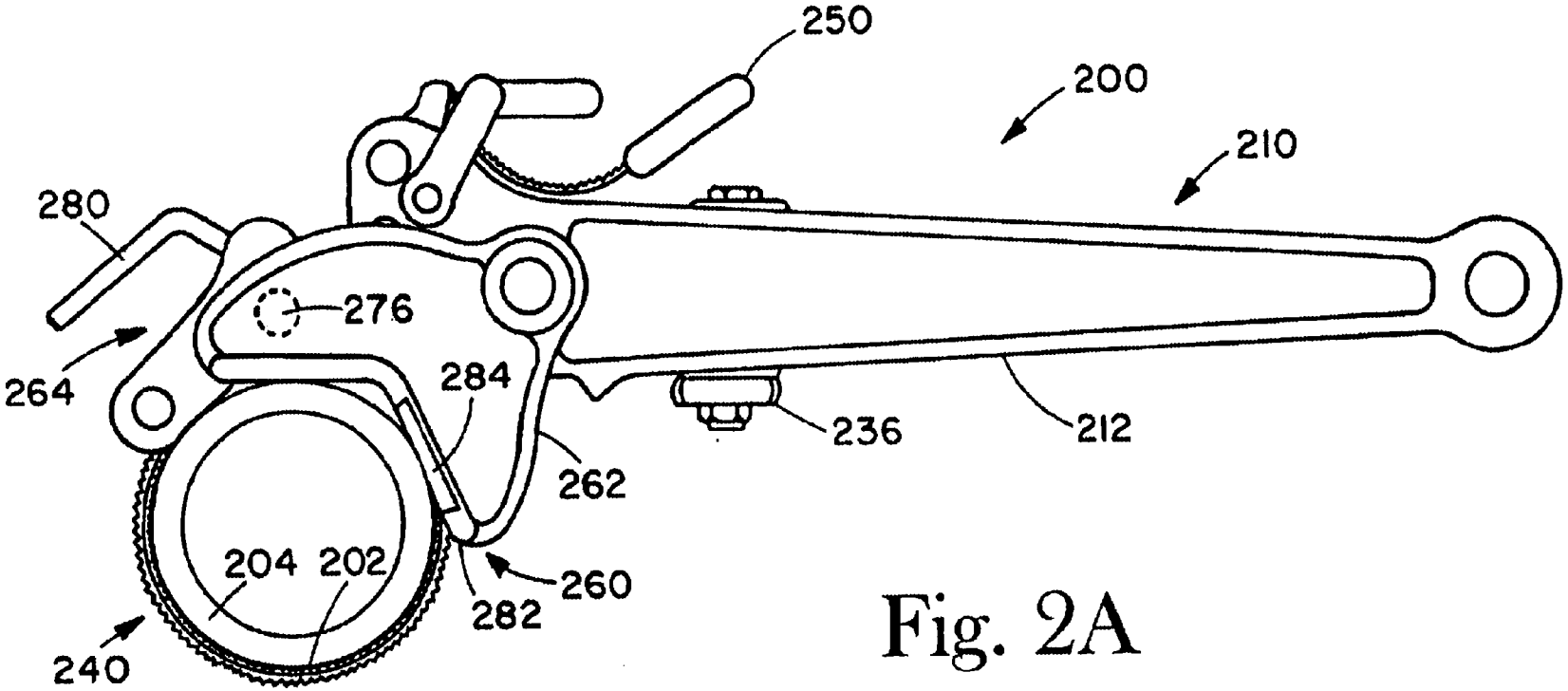
FIG. 2A depicts a top plan view of another preferred embodiment of the tong apparatus of this invention.

Referring now to FIGS. 2A&B, another preferred embodiment of a tong apparatus of this invention, generally 200, is shown to include a handle assembly 210, a composite belt 240 and a jaw assembly 260, where the tong 200 is adapted to engage a surface 202 of a pipe 204 so that the pipe 204 can be rotated or turned.

The handle assembly 210 includes a handle 212, which transmits rotational force to the pipe 204, and a jaw-handle pin 214, which provides a pivoting mount for the jaw assembly 260 to provide leverage to tighten the belt 240 adequately about the pipe 204, to bring the belt 240 into contact with the pipe 204 and to maintain contact between the jaw assembly 260, the belt 240 and the pipe 204. The handle assembly 210 also includes a belt adjusting-locking assembly 216 having a master pin 218, an idler sprocket 220, a lock pin 222, an anchor pin 224 and a spring loaded release arm assembly 226 having a release arm 228 and a spring 230. The adjusting-locking assembly 216 produces a locking force on the belt 240 when tension on the belt 240 causes the sprocket 220 to be pulled into the master and lock pins 218 and 222. The anchor pin 224 is adapted to clamp a free end 252 of the belt 240 under a tensile section 253 of the belt 240. This arrangement of pins provides belt clamping so that the force on the free end of the belt is proportional to the belt tension, which reduces or prevents belt slippage. The release arm 228 is adapted to swing the sprocket 220 away from the pins 218 and 222 to allow for belt clearance for subsequent belt length adjustment, while the spring 230 provides an self-energizing, initial clamping force on the belt 240. The handle assembly 210 also includes a hanger 236 adapted to suspend the tong 200 when working on a pipe that is oriented vertically.

The belt 240 comprises a high tensile strength fiber reinforced polymeric matrix, where the belt 240 is adapted to maintain intimate contact between the tong 200 and the pipe surface 202. The belt 240 is described in more detail in association with FIGS. 3A–D and FIGS. 4A–E. As seen here, the belt 240 includes a pipe engaging surface 242 having teeth, ribs or ridges (see FIGS. 4A–E) for engaging the pipe surface 202 and a smooth non-engaging surface 244. The teeth, ribs or ridges form valleys therebetween as shown in FIGS. 4A–E, which are adapted to provide channels for liquid and/or semi-solid contaminants on the surface 202 of the pipe 204 to be squeezed away from the surface 202 of the pipe 204 as the belt 240 is tightened about the pipe 204. This squeezing action is designed to improve contact between the engaging surface 242 of the belt 240 and the surface 202 of the pipe 204. The belt 240 can also include a belt handle grip 250 encasing an opposite end 254 of the belt 240 and adapted to provide a convenient method for pulling on the belt end 254 for belt adjustment. The free end 252 of the belt 240 is fixed in place in the clamping assembly 216 of the handle assembly 210 as described above. The belt 240 can provide some or all of the frictional interface between the tong 200 and the pipe 204 for transmitting torque from the handle 212 to the pipe 204.

Figures 2B, 2C:
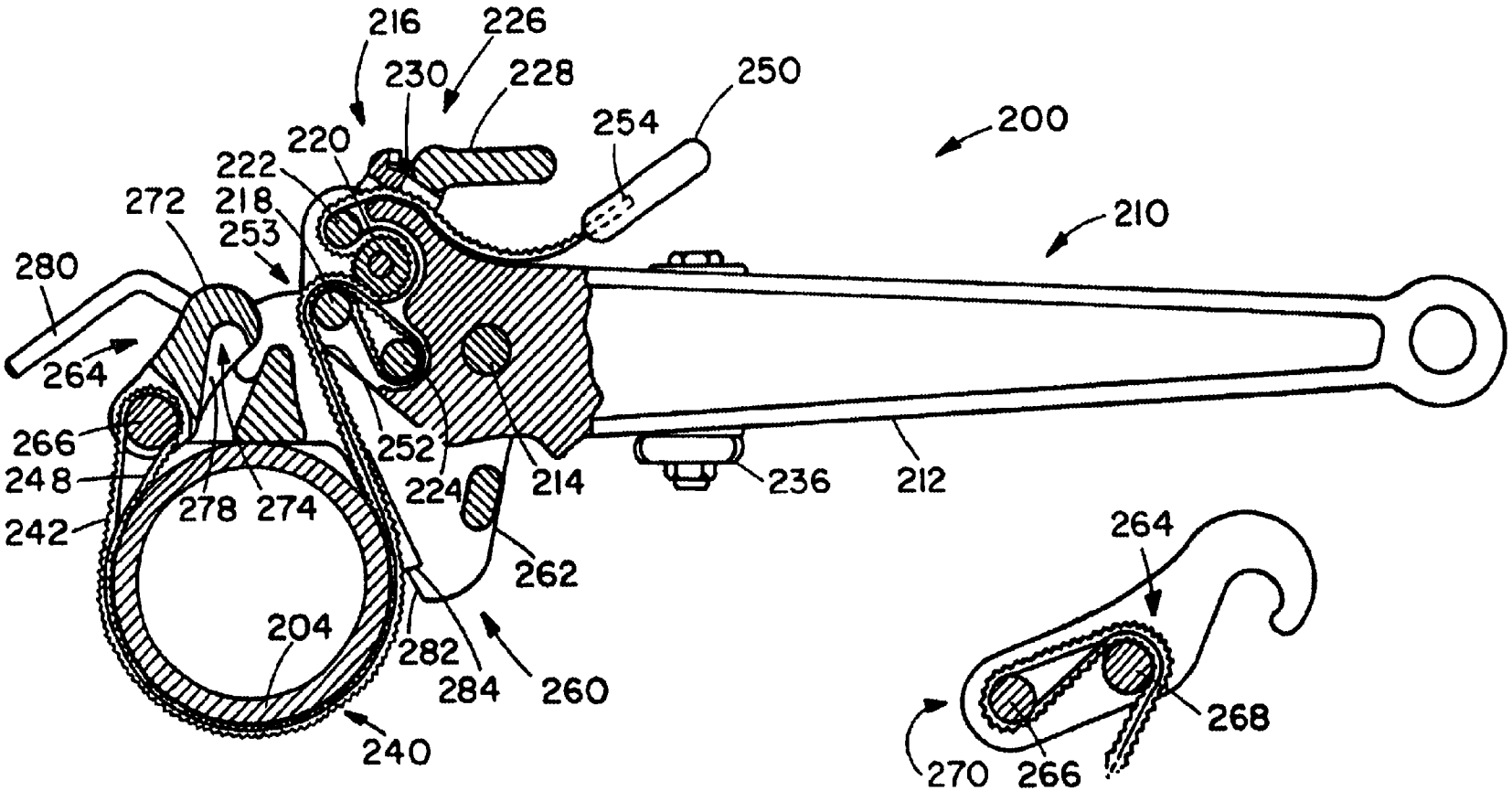
FIG. 2B depicts a top cut away view of the tong apparatus of FIG. 2.
FIG. 2C depicts an expanded view of an alternative hook assembly.
Figure 3A:
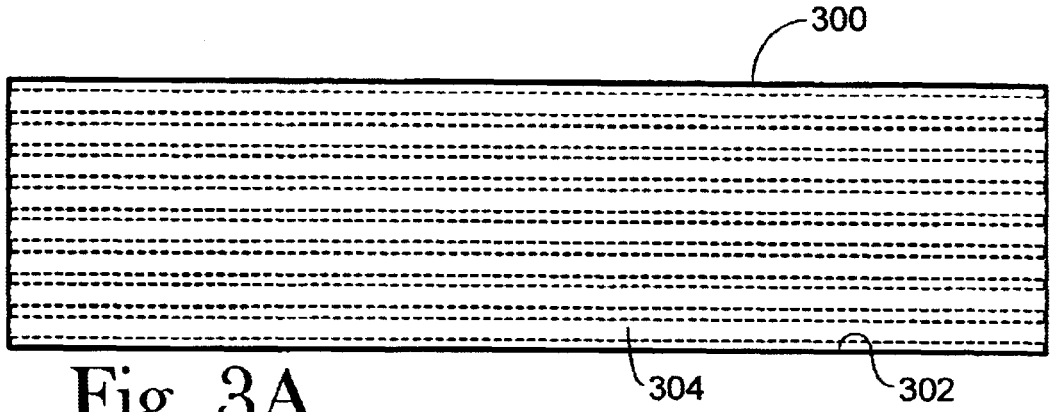
FIGS. 3A–D depict a top and side views of belt configurations of this invention.
Figure 3B:
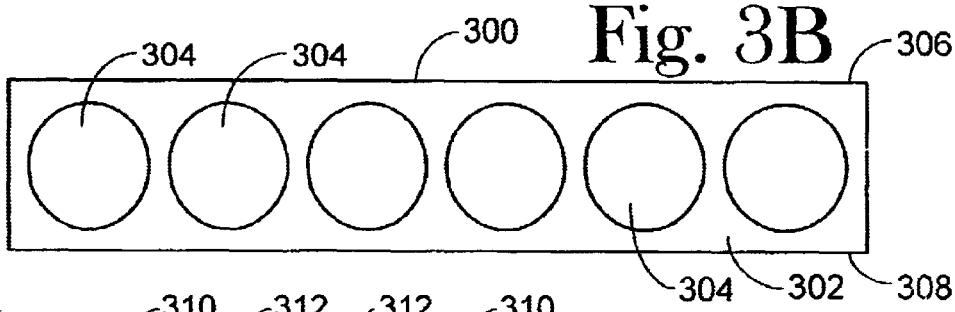
Figure 3C:
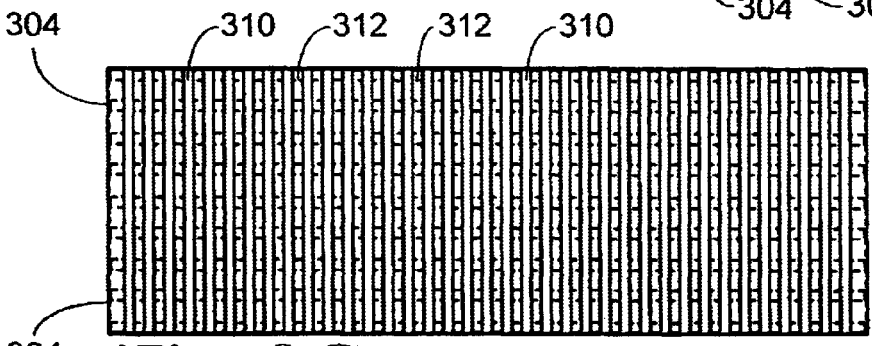
Figure 3D:
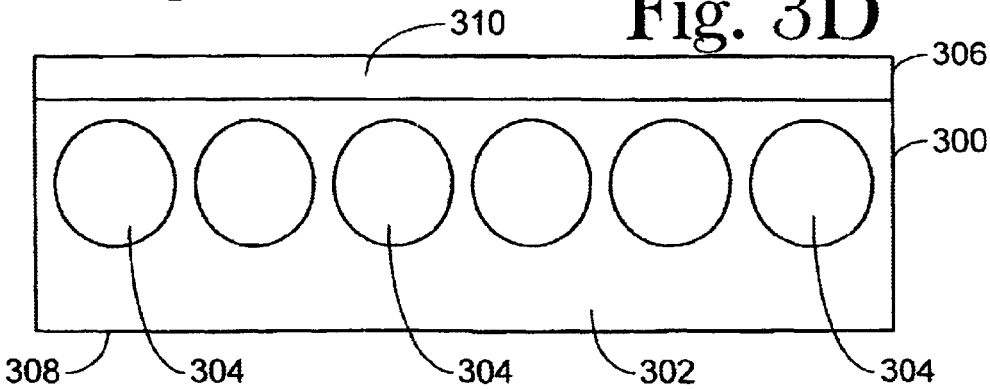

The jaw assembly 260 includes two jaws 262 pivotally mounted on the jaw pin 214 and a hook assembly 264. The hook assembly 264 connects the belt 240 to the jaw assembly 260. The hook assembly 264 includes and a turn pin 266. The turn pin 266 is adapted to allow the belt 240 to be looped around the pin 266 so that the belt 240 is doubled about the pipe 204. Alternatively, as shown in FIG. 2C, the hook assembly 264 can include a turn pin 266 and a guide pin 268, where the guide pin 268 re-routes the belt 240 to allow the tensile force to be concentrated on a double thickness of the belt 240 reducing tensile force on a portion 270 of the belt 240 that loops around the turn pin 266. The hook assembly 264 also includes a hook 272 having two recessed hooking regions 274 adapted to receive hook pins 276 on each jaw 262 separated by a central tab 278. The hook assembly 260 also includes a hook handle 280 adapted to move the hook assembly 264 from an engaged state to an non-engaged state.

The jaws 262 are designed to engage the pipe surface 202 at their exterior surface 282. The jaw assembly 260 can also include an insert 284 which is a toothed metallic part with high hardness to penetrate the surface 202 of the pipe 204 to provide additional tong engagement force against the pipe, i.e., provide a high shear stress engagement between the tong and the pipe as a means of transmitting torque to the pipe. In some instances, the insert 284 may be smooth or even absent when adequate frictional force is provided by the belt and jaw assembly.

The tong 200 is used by positioning the tong 200 on the pipe 204 so that the outer surface 282 of the jaws 262 engage the pipe surface 202. Next, the free belt end 252 is threaded through the belt adjusting-locking assembly 216 as shown in FIG. 2B and then around the pipe 204. Once the belt end 252 is extended around the pipe 204, the belt end 252 is threaded through the hook assembly 264 as shown again in FIG. 2B. The belt handle 250 is then pulled to adjust the belt 240 pulling the idle sprocket 220 into the pins 218 and 222 and applying tension to clamp the belt end 252 in the hook assembly 264. The handle 212 can then be used to rotate the pipe via the belt engaging surface 242 and the jaw surface 282.

Referring now to FIGS. 3A–D, two illustrative examples of belts, generally 300, are shown as comprising a high tensile strength fiber reinforced polymeric matrix 302 including a plurality of spaced apart, parallel longitudinally extending continuous fiber bundles 304 encased or embedded in the polymeric matrix 302. Looking at FIGS. 3A&B, one embodiment of the belt 300 is shown to include two smooth surfaces 306 and 308. Looking at FIGS. 3C&D, another preferred embodiment of the belt 300 is shown to further include laterally extending teeth, ribs or ridges 310 and valleys or grooves 312 on the surface 306 which becomes the pipe engaging surface as described above.

Referring now to FIGS. 4A–E, several illustrative examples of ribbed belts 300 are shown. Looking at FIG. 4A, the ribs 310 and the valleys 312 are substantially rectangular (where rectangular includes a square) in shape. Looking at FIG. 4B, the ribs 310 and the valleys 312 are shown as substantially trapezoidal in shape. Looking at FIG. 4C, the ribs 310 are substantially dome shaped and the valleys 312 are substantially rounded rectangles in shape. Looking at FIG. 4D, the ribs 310 and the valleys 312 are non-symmetric trapezoids in shape, where each trapezoid have a vertical edge 314 and a slanting edge 316 giving rise to a right-hand oriented rib pattern 318. Looking at FIG. 4E, the ribs 310 and the valleys 312 are non-symmetric trapezoids in shape, where each trapezoid have a vertical edge 320 and a slanting edge 322 giving rise to a left-hand oriented rib pattern 324.

Figure 4A:
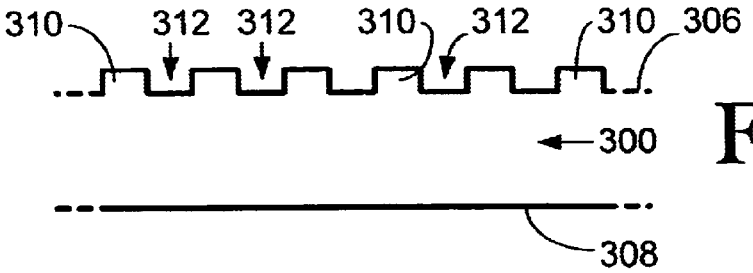
FIGS. 4A–E depict views of surfaces of the belts of FIGS. 3A–D.
Figure 4B:
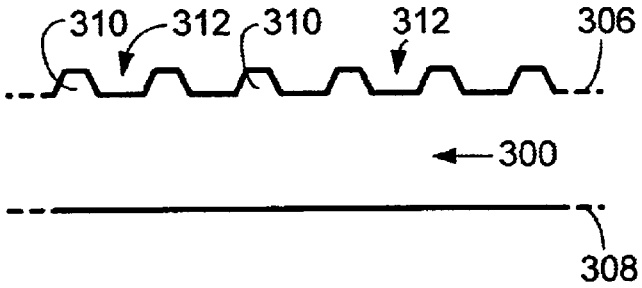
Figure 4C:
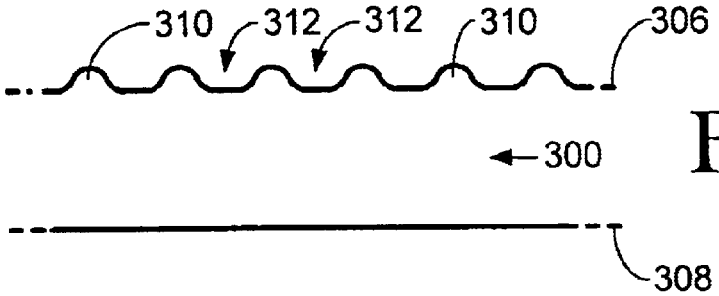
Figure 4D:
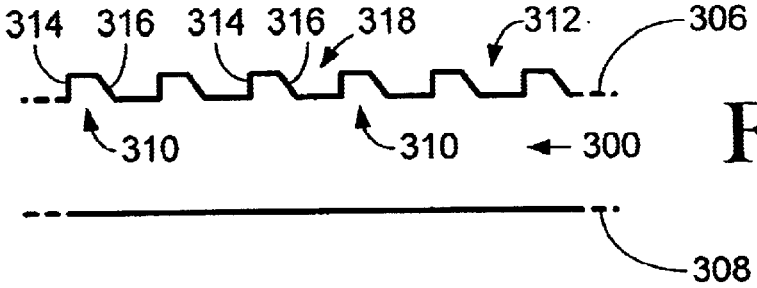
Figure 4E:
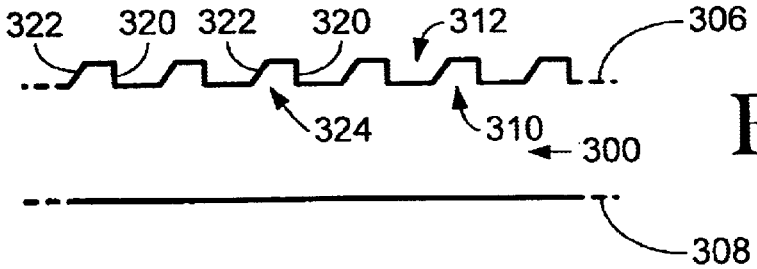
Figure 4F:
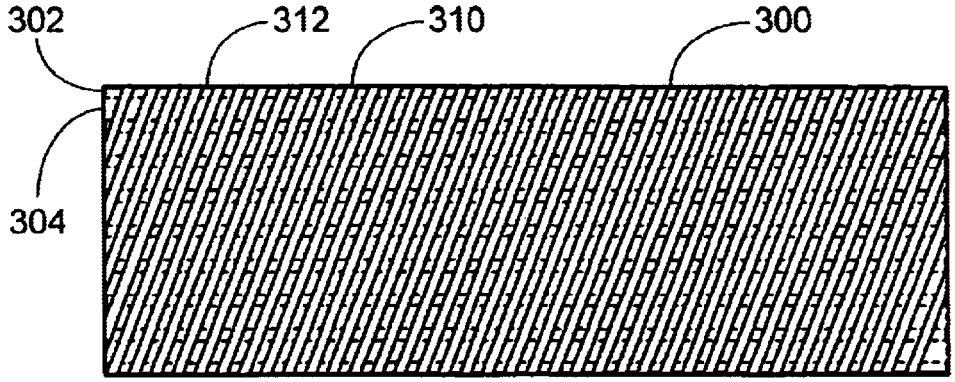
FIG. 4F depicts a top view of a belt with angled ribs and valleys.

Of course, one of ordinary skill in the art can clearly recognize that other rib and valley geometrical shapes can be constructed and that the belts could include mixtures or combinations thereof. In fact, the ribs and valleys do not have to extent longitudinally, but can extend at an angle as shown in FIG. 4F, where the belt 300 has angled ribs 310 and valleys 312.

Figure 5A:
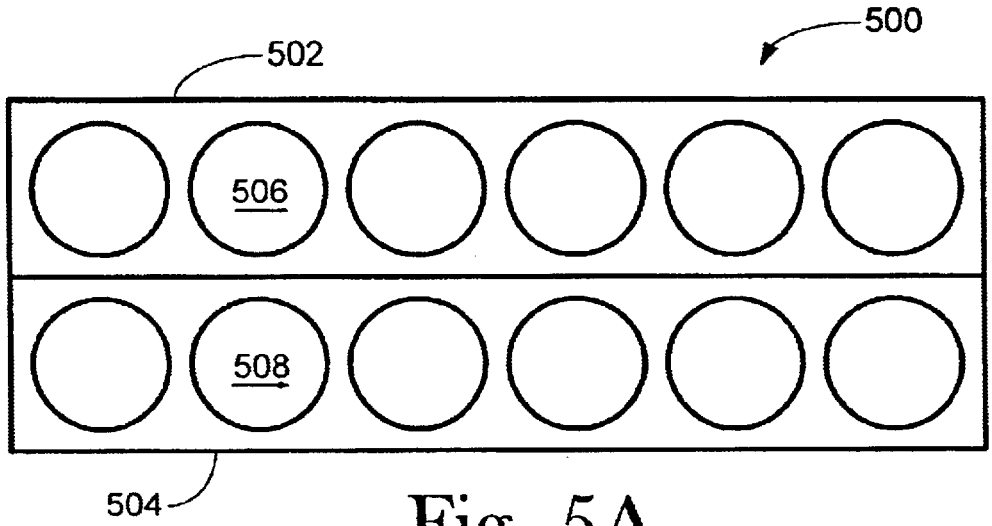
FIGS. 5A–B depict two preferred embodiments of a two ply belt.
Figure 5B:
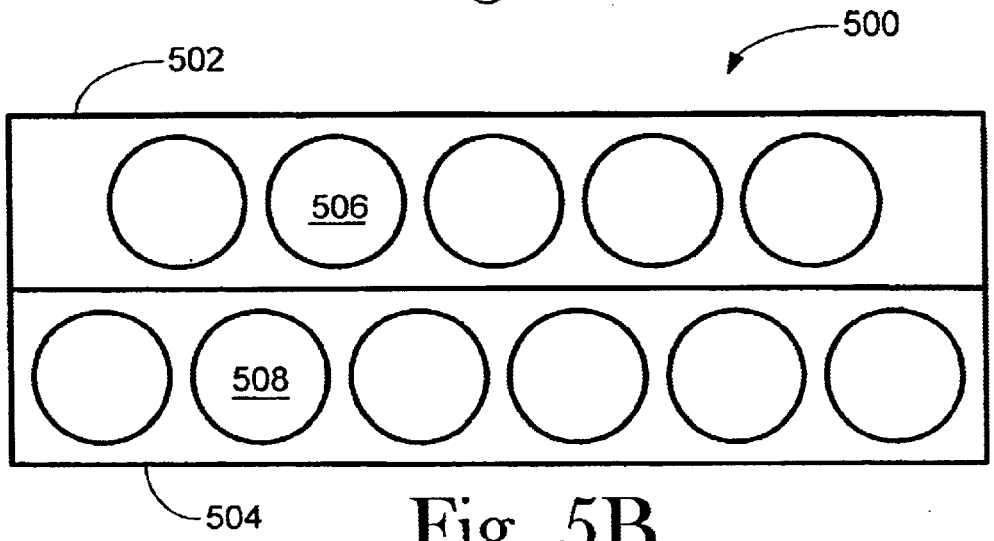
Figure 5C:
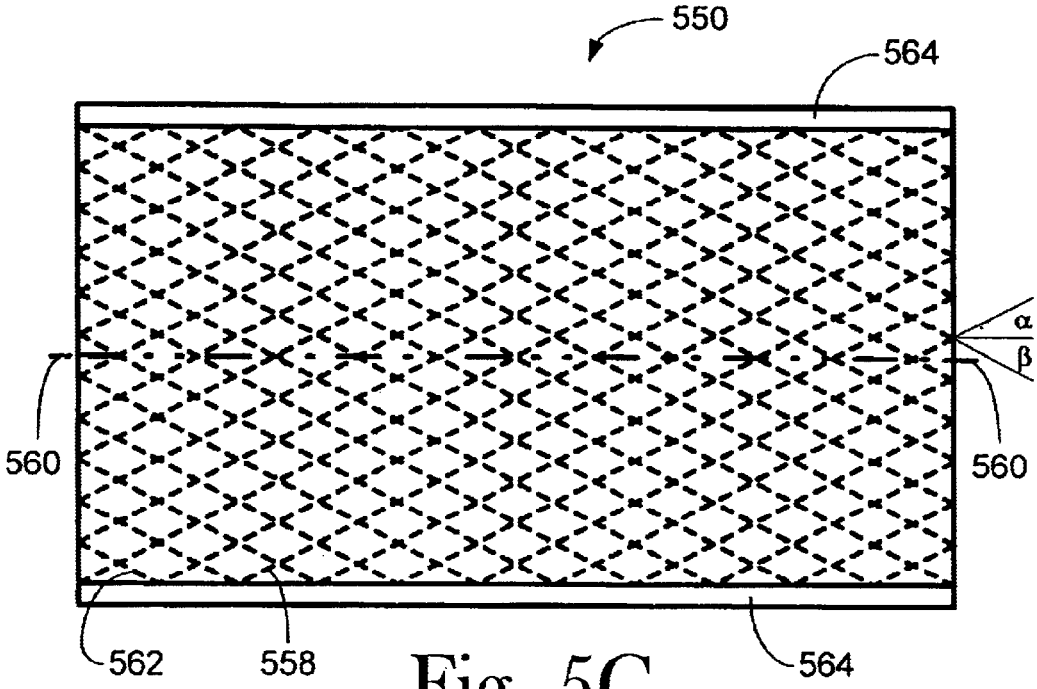
FIGS. 5C–D depict a top view and a side view of a preferred embodiment of a multi-ply belt.
Figure 5D:
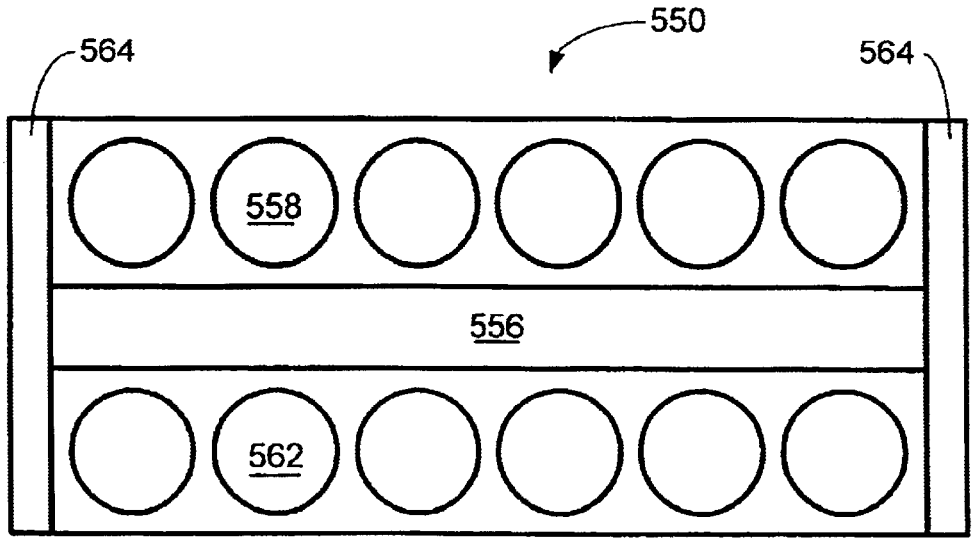

Alternatively, the belt can include more than one ply of reinforcing fibers. In one preferred embodiment of a multi-ply constructions, two fiber reinforced plies are simply staked one on top of the other. Referring now to FIG. 5A, a preferred embodiment of a two-ply belt 500 is shown to include a first reinforced ply 502 and a second reinforced ply 504, where the fibers or fiber bundles 506 and 508 of the plies 502 and 504, respectively, are aligned one on top of the other. Referring now to FIG. 5B, another preferred embodiment of a two-ply belt 500 is shown to include a first reinforced ply 502 and a second reinforced ply 504, where the fibers or fiber bundles 506 and 508 of the plies 502 and 504, respectively, are offset. Referring now to FIGS. 5C&D, a preferred embodiment multi-ply belt 550 is shown to include a first reinforced ply 552 and a second reinforced ply 554 separated by a matrix ply 556. In the first ply 552, fibers or fiber bundles 558 are biased and extend at a first angle $\alpha$ relative to a central longitudinal axis 560, while in the second ply 554, fibers or fiber bundles 562 are also biased and extend at a second angle $\beta$, where $\beta$ preferably is equal to $-\alpha$ as shown. Because the reinforcing plies are cut on a bias, the belt 550 will also preferably include longitudinally extending end caps 564 comprising the polymer matrix to protect the cut ends of the fibers or fiber bundles. Of course, the number of plies can be increased limited only to thickness and weight considerations.

All references cited herein are incorporated herein by reference. While this invention has been described fully and completely, it should be understood that the invention may be practiced otherwise than as specifically described. Although the invention has been disclosed with reference to its preferred embodiments, from reading this description those of skill in the art may appreciate changes and modification that may be made which do not depart from the scope and spirit of the invention as described above.

I claim:

1. A manual tong comprising:

a handle assembly including a handle and a belt adjusting-locking assembly, a jaw assembly including a hook assembly, and a composite belt comprising a polymeric matrix embedding or encasing continuous fibers, yarn, woven strings, wires, continuous bundles, fabric, meshes or mixtures or combinations thereof, where:

the jaw assembly is pivotally mounted on the handle assembly, the belt extends from the hook assembly to the belt adjusting-locking assembly and loops around a pipe, the belt and the jaw assembly are adapted to engage a surface of the pipe permitting the pipe to be rotated or turned by the tong, and the matrix is selected from the group consisting of plastics, thermoplastics, elastomers, urethanes, thermoplastic elastomers, thermosetting materials and mixtures or combinations thereof.

2. The tong of claim 1, wherein the bundles comprise a plurality of continuous fibers, wires or mixtures or combinations thereof.

3. The tong of claim 1, wherein the fibers are selected from the group consisting of carbon fibers, boron-nitride fibers, polyimide fibers, polyimide fibers, glass fibers, and mixtures or combinations thereof.

4. The tong of claim 1, wherein the wires are selected from the group consisting of iron alloy wires and other metal wires having high tensile strengths.

5. The tong of claim 4, wherein the wires includes a bonding layer adapted to improve adhesion between the metal surface and the polymer matrix.

6. The tong of claim 5, wherein the bond layer is selected from the group consisting of copper, zinc, cobalt, brass, bronze, nickel, and mixtures or combinations thereof.

7. The tong of claim 1, wherein the belt includes ribs and valleys on a pipe engaging surface, where the ribs and valleys are adapted to form channels for liquid and/or semi-solid contaminants to be squeezed away from the pipe surface.

8. The tong of claim 1, wherein the handle assembly further includes a ratchet or sprocketed subassembly adapted to tighten the tong on the pipe.

9. The tong of claim 1, wherein the thermosetting materials are selected from the group consisting of epoxy resins, phenolic resins, and mixtures or combinations.

10. A manual tong comprising:

a handle assembly including a handle, a belt adjusting-locking assembly and a release arm assembly, a jaw assembly including a hook assembly, and a composite belt comprising a polymeric matrix embedding or encasing continuous fibers, yarn, woven strings, wires, continuous bundles, fabric, meshes or mixtures or combinations thereof, where:

the jaw assembly is pivotally mounted on the handle assembly, the belt extends from the hook assembly to the belt adjusting-locking assembly and loops around a pipe, the belt and the jaw assembly are adapted to engage a surface of the pipe permitting the pipe to be rotated or turned by the tong, and the matrix is selected from the group consisting of plastics, thermoplastics, elastomers, urethanes, thermoplastic elastomers, thermoserting materials and mixtures or combinations thereof.

11. The tong of claim 10, wherein the bundles comprise a plurality of continuous fibers, wires or mixtures or combinations thereof.

12. The tong of claim 10, wherein the fibers are selected from the group consisting of carbon fibers, boron-nitride fibers, polyamide fibers, polyimide fibers, glass fibers, and mixtures or combinations thereof.

13. The tong of claim 10, wherein the wires are selected from the group consisting of iron alloy wires and other metal wires having high tensile strengths.

14. The tong of claim 13, wherein the wires includes a bonding layer adapted to improve adhesion between the metal surface and the polymer matrix.

15. The tong of claim 14, wherein the bond layer is selected from the group consisting of copper, zinc, cobalt, brass, bronze, nickel, and mixtures or combinations thereof.

16. The tong of claim 10, wherein the belt includes ribs and valleys on a pipe engaging surface, where the ribs and valleys are adapted to form channels for liquid and/or semi-solid contaminants to be squeezed away from the pipe surface.

17. The tong of claim 10, wherein the handle assembly further includes a ratchet or sprocketed subassembly adapted to tighten the tong on the pipe.

18. The tong of claim 10, wherein the thermosetting materials are selected from the group consisting of epoxy resins, phenolic resins, and mixtures or combinations.

19. A method for turning a pipe comprising the steps of:

positioning a tong of any one of claims 1, 8, 2, 6, 7, 10, 17, 11, 15, and 16, adjacent a pipe;

threading the belt through the tong so that the belt extends from the hook assembly to the belt adjusting-locking assembly and loops around the pipe, tightening the belt so that the belt and jaw assembly engage the pipe; and applying a force to the handle to rotate the pipe.

* * * * *